US005645453A

United States Patent [19]

Yamaguchi

[11] Patent Number: 5,645,453

[45] Date of Patent: Jul. 8, 1997

[54] CONNECTOR

[75] Inventor: Noboru Yamaguchi, Shizuoka, Japan

[73] Assignee: Yazaki Corporation, Tokyo, Japan

[21] Appl. No.: 624,862

[22] Filed: Mar. 27, 1996

[30] Foreign Application Priority Data

Mar. 31, 1995 [JP] Japan ..... 7-075353

[51] Int. Cl.[6] ..... H01R 13/436

[52] U.S. Cl. ..... 439/595

[58] Field of Search ..... 439/595, 752

[56] References Cited

U.S. PATENT DOCUMENTS

| | | | |
|---|---|---|---|
| 4,797,116 | 1/1989 | Isohata et al. | 439/595 |
| 5,520,553 | 5/1996 | Cecil, Jr. et al. | 439/595 |

FOREIGN PATENT DOCUMENTS

| | | |
|---|---|---|
| 63-37085 | 3/1988 | Japan . |
| 4-102576 | 9/1992 | Japan . |
| 7-34570 | 6/1995 | Japan . |

*Primary Examiner*—Gary F. Paumen

*Attorney, Agent, or Firm*—Morgan, Lewis and Bockius, LLP

[57] ABSTRACT

A connector includes a front holder adapted to be removably mounted to a connector housing from the front side thereof, the front holder having elastic retaining pieces for retaining female terminals to prevent the terminals from rearward withdrawal from the connector housing. The connector housing includes a holder abutting portions for abutting against the elastic retaining pieces, which are deflecting position not to engage the female terminals under a temporary retained condition of the front holder, to prevent the movement of the front holder toward a regularly retained condition, and elastic retaining piece holding portions for preventing the elastic retaining pieces, which retains the female terminals under the regularly retained condition of the front holder, from deflecting in the disengagement direction.

4 Claims, 6 Drawing Sheets

CONNECTOR

BACKGROUND OF THE INVENTION

1. Field of the Invention

This invention relates to a connector of a type in which a terminal secured to an end of a wire is retained within a connector housing by using an elastic retaining piece, and in particular, to a connector which allows a terminal to be retained within a connector housing securely and to be drawn out easily.

2. Background

Conventionally, in order to connect wires to each other, a various connectors are used in which there is a connector designed to retain terminals within a housing by using elastic retaining pieces.

For example, Japanese Unexamined Utility Model Publication No. 4-102576 discloses a connector in which, as shown in FIG. 6, once a female terminal 3 is inserted into a terminal receptacle 2 in a connector housing 1, from right side as viewed in the drawing, the female terminal 3 is retained by an engagement between a retaining projection 5 of an elastic retaining piece 4 and retaining hole 6 of the female terminal 3 to prevent the female terminal from rearward withdrawal. Further, a spacer 7 is inserted into a space beneath the elastic retaining piece 4, the female terminal 3 is securely held within the connector housing 1 since the insertion of the spacer 7 prevents the lowering deflection of the elastic retaining piece 4 disengaging the retaining projection 5 and retaining hole 6.

Japanese Unexamined Utility Model Publication No. 63-37085 discloses another connector in which, as shown in FIG. 7, once a female terminal 13 secured to a wire 14 is inserted into a terminal receptacle 12 in a connector housing 11, from right side as viewed in the drawing, the female terminal 13 is retained within the connector housing 11 through an engagement with an elastic retaining pieces 15. Once a spacer 16 is mounted to an opening in the connector housing 11 from left side as viewed in the drawing, an elastic engaging piece 17 provided on the spacer 16 engages the female terminal 13, thus the female terminal 13 is retained by double engagement.

Furthermore, if the engagement between the terminal 13 and the elastic retaining piece 15 is insufficient, as shown in the bottom half in FIG. 7, the female terminal 13 is forced out to the right side in the drawing by the elastic engaging piece 17 of the spacer 16 when the spacer 16 is mounted to the connector housing 11. This provides a simple recognition of unengagement of the female terminal 13.

However, the connector, shown in FIG. 6, encounters a problem that the deformation of the elastic retaining piece 4 is small, and the spacer 7 can be inserted even if the space beneath the elastic retaining piece 4 is smaller than a predetermined gap, which allows the insertion of the spacer 7 under an insufficient engagement between the female terminal 3 and the elastic retaining piece 4, therefore the connector cannot provide a reliable recognition of unengagement of the female terminal 3 by the elastic retaining piece 4. Further, in order to draw the female terminal 3 from the terminal receptacle 2, an ejector tool must be inserted into the connector housing 1 through the terminal insertion hole to deform the elastic retaining piece 4 downwardly. However, there is another problem that the ejecting work of the female terminal 3 is not easy since the insertion of the ejector tool is difficult and the leading portion of the elastic retaining piece 4 can be easily broken.

On the other hand, the connector, shown in FIG. 7, encounters a problem that the ejecting work of the female terminal 13 is difficult because of the double engagement of the female terminal 13. That is, in order to draw the female terminal 13 from the connector housing 11, an ejector tool, not shown, must be inserted in the terminal receptacle 12 through a mating terminal insertion hole, provided on left side in drawing, to disengage the female terminal 13 from the elastic retaining piece 15 and the elastic engaging piece 17, which may results in a possible damage on the female terminal 13 due to a scratch by the ejector tool inserted through the mating terminal insertion hole.

SUMMARY OF THE INVENTION

The present invention is directed to solve the problems described above, and an object of the invention is to provide a connector which allows a terminal to be retained within a connector housing securely and to be drawn out easily.

In order to achieve the object of the invention, there is provided a connector including a connector housing adapted to receiving a terminal, which is secured to an end of a wire and inserted into a terminal receptacle from a rear side; and a front holder adapted to be mounted to the connector housing from the front side thereof, the front holder having an elastic retaining piece for retaining the terminal to prevent the terminal from rearward withdrawal from the connector housing, a holder abutting portion for abutting, under a temporary retained condition, against the elastic retaining piece, which are deflecting position not to retain the terminal, to prevent the movement of the front holder toward a regularly retained condition; and an elastic retaining piece holding portion for preventing the elastic retaining piece, which retains the terminal under the regularly retained condition of the front holder, from deflecting in the disengagement direction.

Preferably, an engagement member is provided between the connector housing and the front holder, which can hold the front holder to the connector housing in the temporary or the regularly retained condition.

According to the connector thus formed, under the temporary retained condition of the front holder respective to the connector housing, the terminal is retained by the elastic retaining piece of the front holder, which prevents the terminal from rearward withdrawal when the terminal secured to the end of wire is inserted from the rear side of the terminal receptacle.

From this condition, when the front holder is connected to the connector housing for the regularly retained condition, the terminal mounted to the connector is securely prevented from rearward withdrawal since the elastic retaining piece holding portion prevent the deflection of the elastic retaining piece in the disengagement direction.

Further, under the temporary retained condition, the terminal is not completely retained by the elastic retaining piece of the front holder, and when the elastic retaining piece is at the deflected position, the front holder and the connector housing cannot be connected, which provides a simple recognition of abnormal assembly of the terminal, since the elastic retaining piece abuts the holder abutting portion of the connector housing to prevent the front holder from moving to the regularly retained condition.

Furthermore, a defect such as fracture and bend of the elastic retaining piece can be easily found since the elastic retaining piece, which prevent the terminal from rearward withdrawal, is provided on the front holder which is removably mounted to the connector housing. Yet furthermore, in order to remove the terminal from the connector, disengagement between the elastic retaining piece and the terminal can be easily carried out since the elastic retaining piece is exposed by drawing out the front holder from the connector housing.

DETAILED DESCRIPTION OF THE PREFERRED EMBODIMENTS

With reference to the attached drawings, an embodiment of a connector according to the invention will be described hereinafter in detail.

Figure 1:
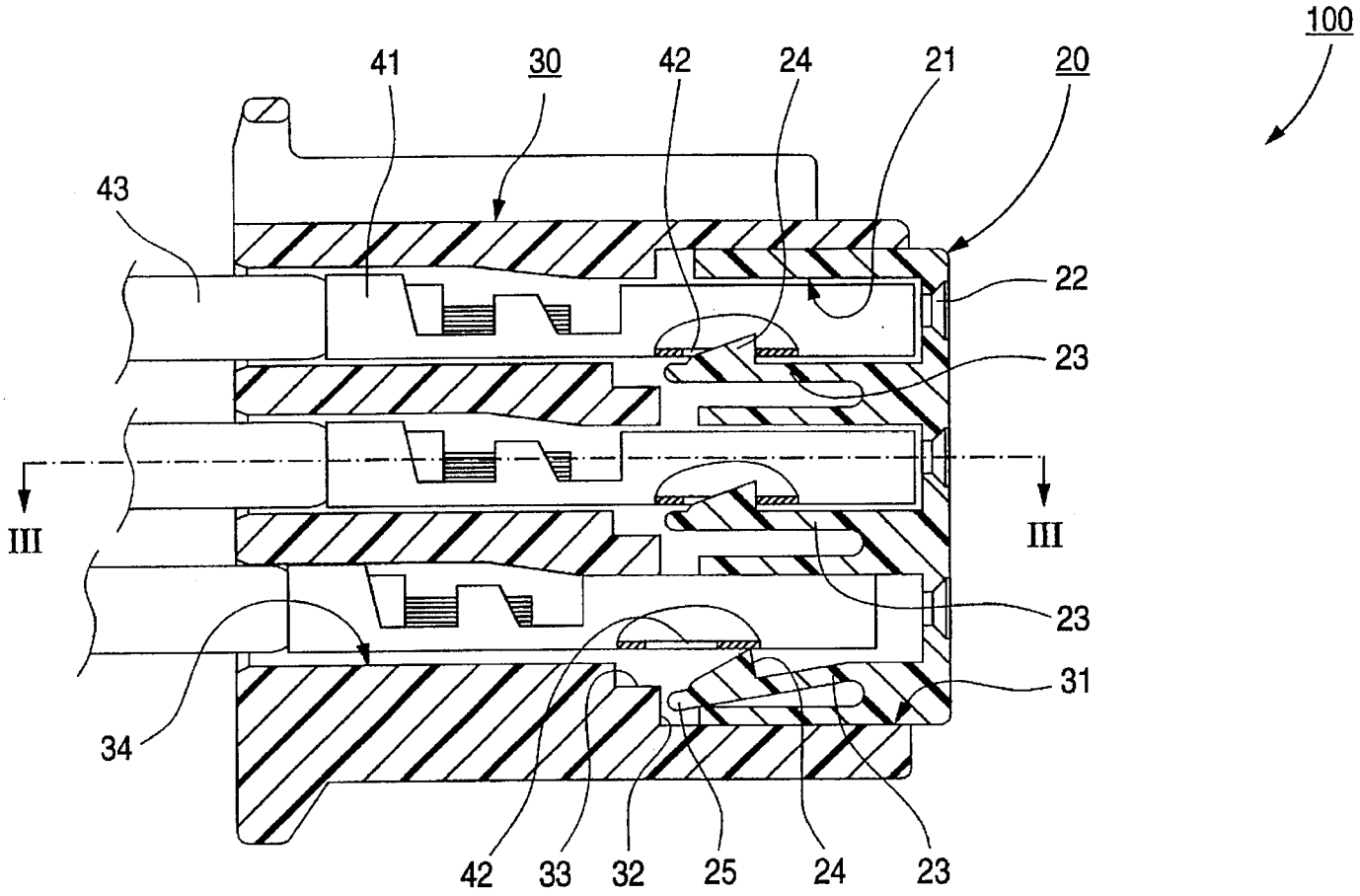
FIG. 1 is a longitudinal cross-sectional view of a connector according to an embodiment of the invention, in which the front holder is under temporary retained condition respective to the connector housing.
Figure 2:
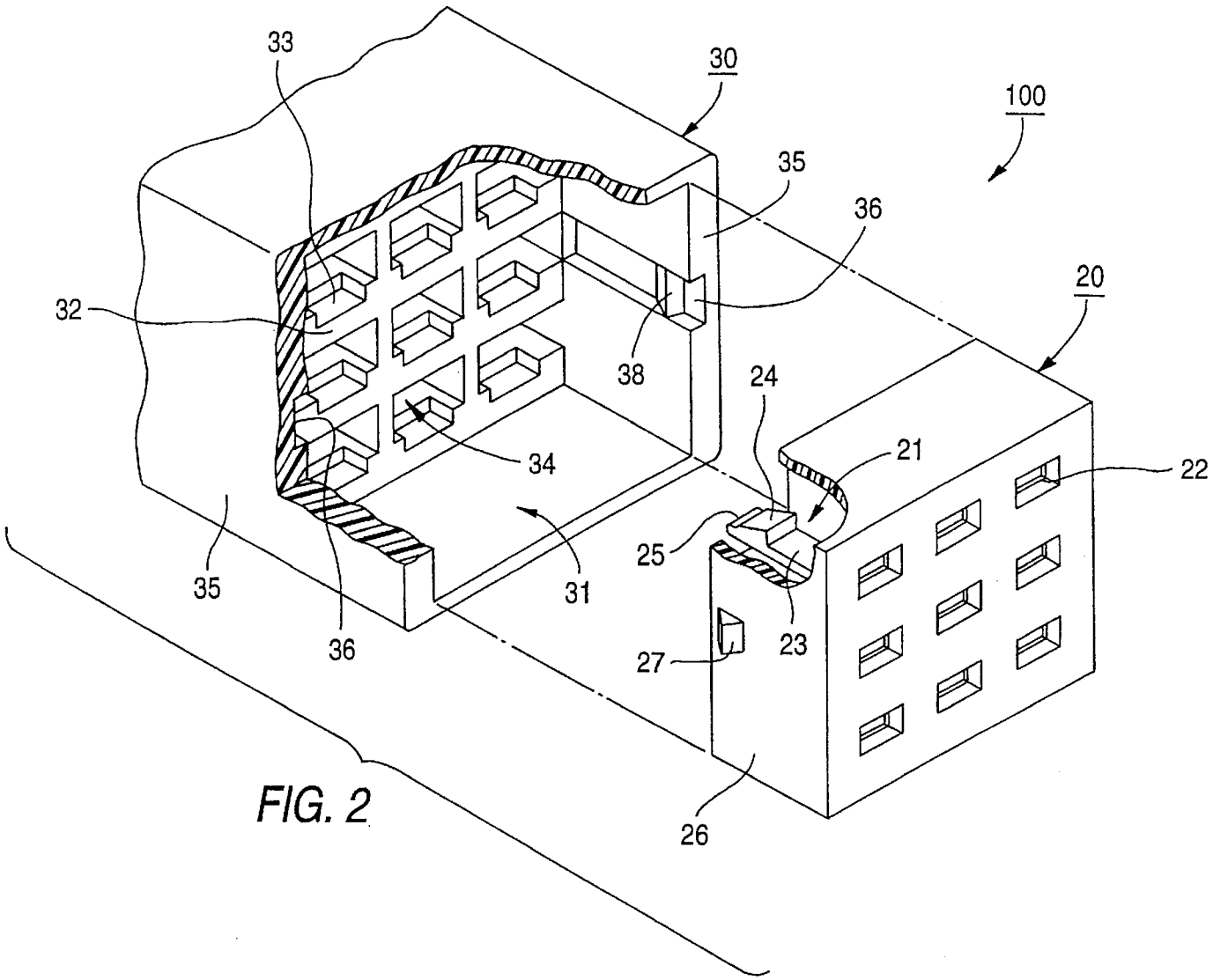
FIG. 2 is a partial fragmental perspective view of the connector shown in FIG. 1.

As shown in FIGS. 1 and 2, a connector 100 of the embodiment includes a connector housing 30 with terminal receptacles 34 for receiving female terminals 41 secured to ends of wires 43, and a front holder 20 which is removably mounted to the connector housing 30 from the front side of the housing.

Figure 3:
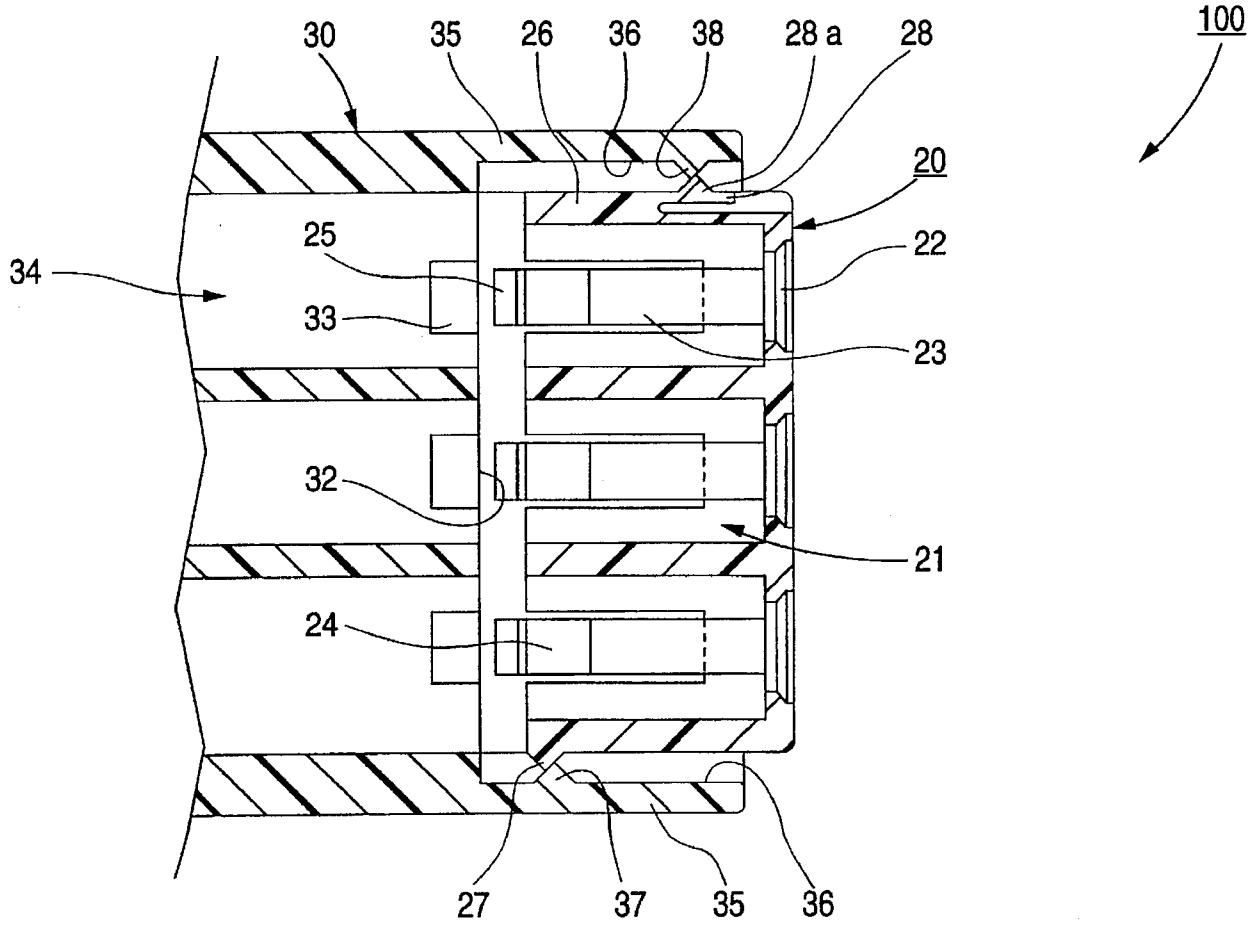
FIG. 3 is a cross-sectional view of the connector shown in FIG. 1 taken along line III—III.

The front holder 20 is substantially formed into a rectangular parallelepiped block of a resin, within which nine terminal holding portions 21 are defined by partition walls and arranged into an array of three rows and columns. Within each of the terminal holding portions 21, elastic retaining pieces 23, in a cantilever like, of which leading edge portions 25 outwardly extend from the openings of the terminal holding portions 21, and terminal insertion holes 22 are provided. Further, as shown in FIG. 3, on each side walls 26, 26 of the front holder 20, an engagement projection 27 at the distal end of the side wall (left side in FIG. 3), and an engagement projection 28*a* on an elastic engagement piece 28 which is provided at the proximal end of the side wall, are provided.

The connector housing 30 is substantially formed into a rectangular parallelepiped block of a resin, and a front holder receptacle 31, for receiving the front holder 20, is provided at right side as viewed in FIG. 1. Terminal receptacles 34, through which female terminals 41 secured to the ends of wires are inserted, are arranged into an array of three rows and columns so as to open to the front holder receptacle 31. And, at an opening portion which the terminal receptacles 34 are opened to the front holder receptacle 31, holder abutting portions 32, which, in order to prevent the movement of the front holder 20 toward a regularly retained (fully inserted) condition, abut against the leading edge portions 25 of the elastic retaining pieces 23 deflecting, and elastic retaining piece holding portions 33, which prevent the deflection of the elastic retaining pieces 23 in the disengagement direction under the regularly retained condition, are arranged into a step configuration.

Further, on each side walls 35, 35 of the connector housing 30, a pair of guide grooves 36, 36, for receiving the engagement projections 27 and 28*a* formed on the front holder 20, are provided to face to each other. In the guide grooves 36, 36, engaging projections 37 and 38 are formed as a engaging member which can hold the front holder 20, both under a temporary retained condition and the regularly retained condition, through the engagement with the engagement projections 27 and 28*a* respectively.

The functional operation of the embodiment, described above, for retaining the female terminal 41 to the connector 100 will be described.

Once the front holder 20 is inserted into the front holder receptacle 31 of the connector housing 30, the engagement projections 27 and 28*a* formed on each of the side walls 26, 26 of the front holder 20 enter the pair of the guide grooves 36 formed in the inner surfaces of the either walls 35, 35, and the engagement projection 27 abuts against the engaging projection 37.

As shown in FIG. 3, when the front holder 20 is further pressed and inserted, one of the engagement projection 27 of the front holder 20 moves to the inner side of the guide groove 36 beyond the engaging projection 37 of the connector housing 30 while the other engagement projection 28*a* of the front holder 20 abuts against the engaging projection 38 of the connector housing 30 and remains at the outer side of the guide groove 36. This condition is the temporary retained condition under which not only can the front holder 20 be inserted into the front holder receptacle 31 of the connector housing 30 but also drawn out from the connector housing 30.

Under the temporary retained condition described above, as shown in FIG. 1, the leading edge portions 25 of the elastic retaining pieces 23 are separated from the elastic retaining piece holding portions 33 of the connector housing 30, which allows the elastic retaining pieces 23 to deflect downwardly as viewed in the drawings. Thus, once the female terminals 41, which are inserted from the rear side of the terminal receptacles 34 formed through the connector housing 30, are inserted into the terminal holding portions 21 of the front holder 20 held under the temporary retained condition respective to the connector housing 30, retaining projections 24 of elastic retaining pieces 23 engage retaining holes 42 formed in the female terminals 41 to hold the female terminals 41 within the terminal holding portions 21.

When the front holder 20 is pressed and inserted into the front holder receptacle 31 of the connector housing 30 after the female terminals 41 are held within the terminal holding portions 21 respectively, leading faces 29, relative to the insertion direction, of the front holder 20 abuts against abutting portions 32 of the connector housing 30 and stops.

Under this condition, the front holder 20 is regularly retained respective to the connector housing 30 since the engagement projection 28*a*, formed on the elastic engagement piece 28 of the front holder 20 shown in FIG. 3, moves to the inner side of the guide groove 36 beyond the engaging projection 38 of the connector housing 30.

Figure 4:
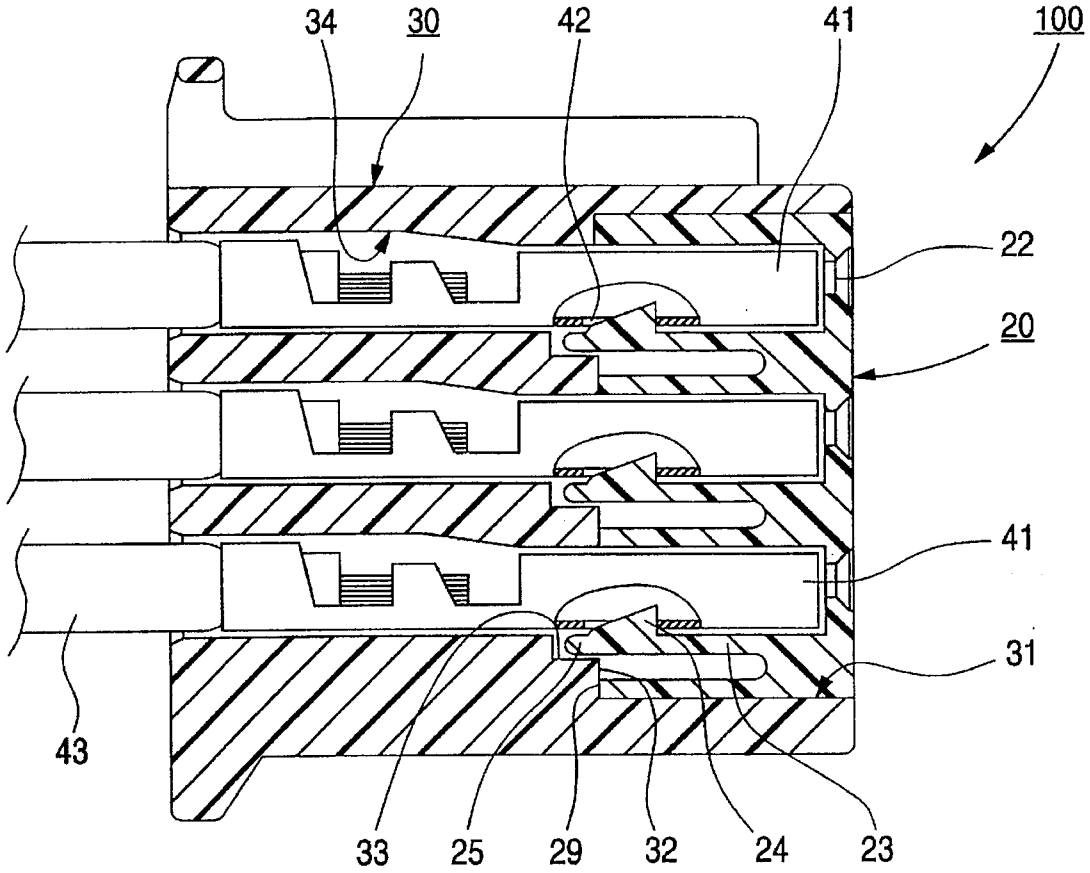
FIG. 4 is a longitudinal cross-sectional view of a connector shown in FIG. 1, in which the front holder is under regularly retained condition respective to the connector housing.

Under the regularly retained condition, as shown in FIG. 4, the leading edge portions 25 of the elastic retaining pieces 23 are over the elastic engagement piece holding portions 33 of the connector housing 30, which prevents the elastic retaining pieces 23 from deflecting in the disengagement direction (downward in the drawings). Thus, the engagement between the engaging holes 42 of the female terminals 41 and the retaining projections 24 of the elastic retaining pieces 23 cannot be disengaged whereby the female terminals 41 mounted to the connector 100 are securely prevented from rearward withdrawal.

On the other hand, for example, if at least one of the female terminals 41 is not sufficiently engaged with one of the elastic retaining pieces 23 corresponding to the female terminal 41 under the temporary retained condition of the front housing 20, as shown by the lowest portion in FIG. 1, the elastic retaining piece 23 is remained at the downwardly deflected position. Under this condition, the regularly retained condition as shown in FIG. 4 cannot be performed since the leading edge portion 25 of the elastic retaining piece 23 abuts against the holder abutting portion 32 of the connector housing 30 to prevent the front holder 20 from moving to the regularly retained condition when the front holder 20 is regularly retained to the connector housing 30.

Therefore, the assembling worker cannot connect the front holder 20 to the connector housing 30, which allows the worker to notice easily that the female terminals 41 are not appropriately received within the terminal holding portions 21. Thus, insufficient assembly of the connector 100, in which the female terminals 41 are defectively mounted, is avoided.

Figure 5:
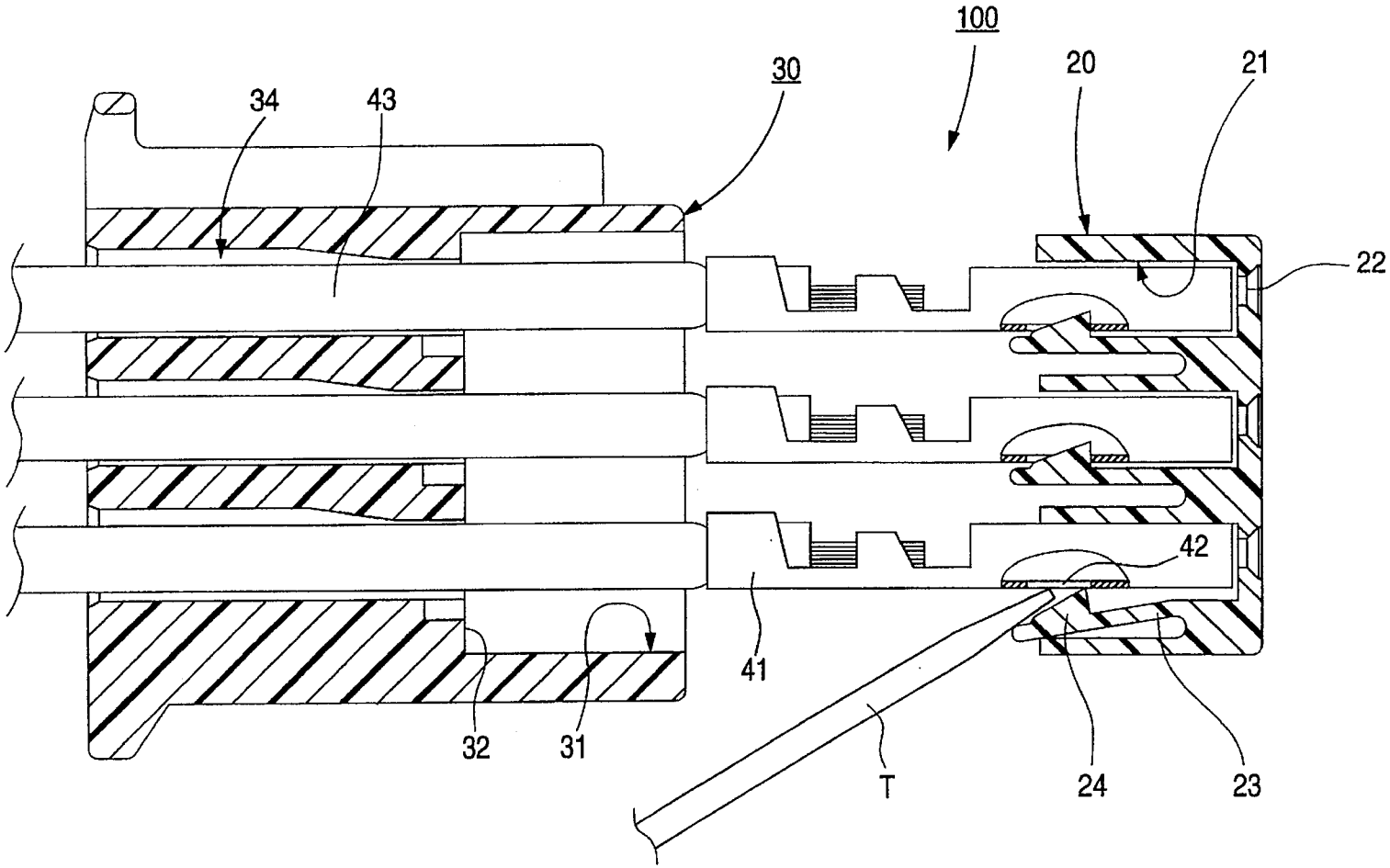
FIG. 5 is a longitudinal cross-sectional view illustrating the method of removing the terminal from the connector.
Figure 6:
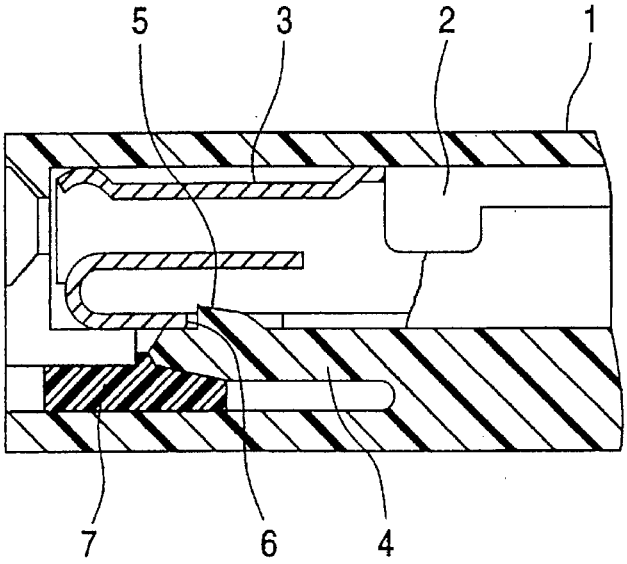
FIG. 6 PRIOR ART
FIG. 6 is a partial cross-sectional view of a conventional connector.
Figure 7:
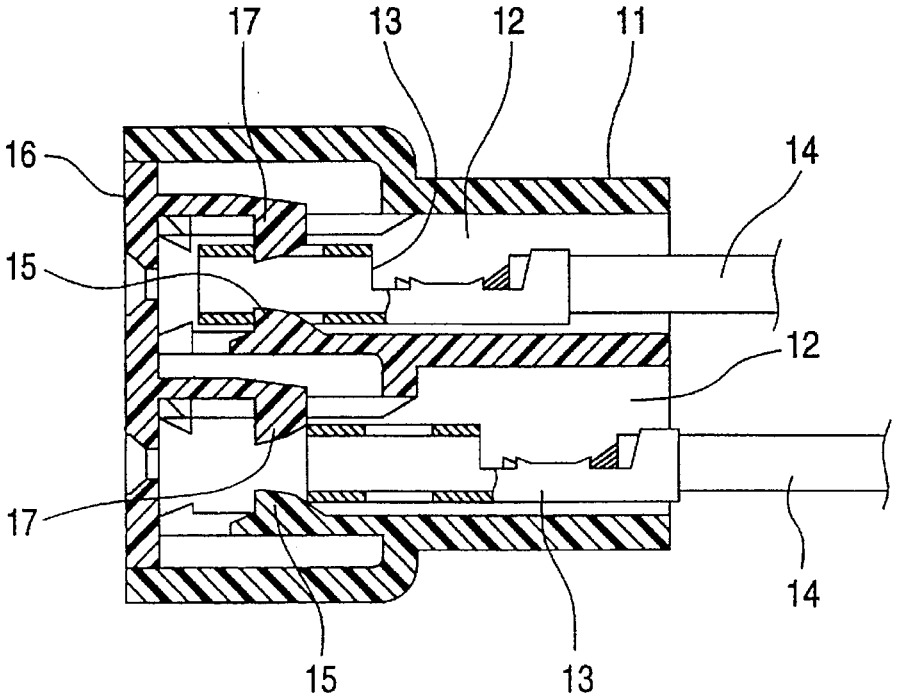
FIG. 7 PRIOR ART
FIG. 7 is a longitudinal cross-sectional view of another conventional connector.

In order to remove the female terminals 41 from the connector 100, the front holder 20, together with the female terminals 41 inserted within the terminal holding portions 21, is drawn from the front holder receptacle 31 as shown in FIG. 5. The elastic retaining pieces 23 can be easily deflected by using an ejector tool T to disengage the female terminals 41 from the elastic retaining pieces 23 since the elastic retaining pieces 23, of which the retaining projections 24 engage the engagement holes 42 of the female terminals 41, are exposed.

Thus, the female terminals 41 can be easily removed from the connector 100 without scratches on the female terminals 41 by the ejector tool T nor damage on the elastic retaining pieces 23.

Further, the elastic retaining pieces 23 can be exposed under a directly visible condition by removing the front holder 20 from the connector housing 30 since the elastic retaining pieces 23, for preventing the female terminals 41 from rearward withdrawal from the connector 100, are formed on the front holder 20 which is removably mounted to the connector housing 30. Therefore, in the connector 100, defect such as fracture and bend of the elastic retaining pieces 23 can be easily found. When the defect of the elastic retaining pieces 23 is found, only the front holder 20 is changed, thus the maintenance cost of the connector 100 is reduced.

Furthermore, the connector of the invention can be produced by a simple dies for the connector housing 30 and the front holder 20 compared with the conventional art connector in which the elastic retaining pieces, for preventing the terminals from rearward withdrawal, are provided within the terminal receptacles of the connector housing, thus the production cost is reduced.

It is apparent that the connector according to the invention is not limited to the embodiment described above and various changes and modifications on the form and the arrangement of the connector housing, the front holder and the elastic retaining pieces can be made without departing from the spirit and scope of the invention. Further, it is also apparent that the engagement member, which can hold the front holder to the connector housing under the temporary or regularly retained condition, is not limited to the engagement projections 27 and 28*a* and the engaging projections 37 and 38 and another arrangement can be made.

According to the connector of the present invention, the terminals mounted to the connector are securely prevented, by the elastic retaining pieces, from rearward withdrawal since the elastic retaining piece holding portions prevent the deflection of the elastic retaining pieces in the disengagement direction.

Further, when front holder under the temporary retained condition is moved to the regularly retained condition, if the elastic retaining pieces are not completely retained and are at the deflected position, the front holder and the connector housing cannot be connected, which provides a simple recognition of abnormal assembly of the terminals, since the elastic retaining pieces abut the holder abutting portions of the connector housing to prevent the front holder from moving to the regularly retained condition. Thus, insufficient assembly of the connector, in which the female terminals are defectively mounted, is avoided.

Further, a defect such as fracture and bend of the elastic retaining pieces can be easily found since the elastic retaining pieces are provided on the front holder which is removably mounted to the connector housing and the elastic retaining pieces can be exposed under a directly visible condition by removing the front holder from the connector housing.

Yet furthermore, in order to remove the terminals from the connector, disengagement between the elastic retaining pieces and the terminals can be easily carried out since the elastic retaining pieces are exposed by removing out the front holder from the connector housing.

Thus, according to the invention, a connector, which allows a terminal to be retained within a connector housing securely and to be drawn out easily, is provided.

What is claimed is:

1. A connector, comprising:

a housing;

a front holder removably mounted to said housing from a front side of said housing, said front holder including a terminal holding portion for holding a terminal in which an elastic retaining piece for retaining the terminal is formed;

a front holder receptacle formed in a front portion of said housing for receiving said front holder;

a terminal receptacle formed in said housing to receive the terminal, said terminal receptacle being arranged to open to said front holder receptacle;

a holder abutting portion formed on said terminal receptacle, said holder abutting portion preventing full insertion of said front holder into said front holder receptacle when the elastic retaining piece is not properly engaged with the terminal and a leading edge portion of the elastic retaining piece abuts against said holder abutting portion; and a holding portion formed on said terminal receptacle so as to be arranged into a step configuration together with said holder abutting portion, said holding portion preventing a disengaging movement of the elastic retaining piece from the terminal.

2. The connector of claim 1, wherein engagement members are provided between said front holder and said housing so as to engage said front holder with said housing.

3. The connector of claim 2, wherein said engagement members include a first engagement projection formed at a distal end portion of a first side wall of said front holder, a second engagement projection formed on an elastic engaging piece which is provided at a base end portion of a second side wall of said front holder opposite to the first side wall, a third engaging projection formed at a base end portion on a third inner-side wall of said front holder receptacle so as to engage said first engagement projection, and a fourth engaging projection formed at a front end portion on a fourth inner-side wall of said front holder receptacle opposite to the third inner-side wall so as to engage said second engagement projection.

4. The connector of claim 1, wherein the elastic retaining piece has a retaining projection fore engagement with a retaining hole formed in the terminal.

* * * * *